US008222893B2

(12) United States Patent
Holfeld

(10) Patent No.: US 8,222,893 B2
(45) Date of Patent: Jul. 17, 2012

(54) STRINGLINE AND CROSS-LEVEL GAUGE

(75) Inventor: Donald R. Holfeld, Mount Laurel, NJ (US)

(73) Assignee: HARSCO Corporation, Camp Hill, PA (US)

( * ) Notice: Subject to any disclaimer, the term of this patent is extended or adjusted under 35 U.S.C. 154(b) by 236 days.

(21) Appl. No.: 12/408,160

(22) Filed: Mar. 20, 2009

(65) Prior Publication Data

US 2010/0237857 A1 Sep. 23, 2010

(51) Int. Cl.
*G01B 7/14* (2006.01)

(52) U.S. Cl. ..... 324/207.2; 33/338

(58) Field of Classification Search ..... 33/338, 33/651, 1 Q; 324/754, 758, 207.2
See application file for complete search history.

(56) References Cited

U.S. PATENT DOCUMENTS 1,417,703 A * 5/1922 Waffenschmidt ..... 33/501
1,751,393 A * 3/1930 Busby ..... 33/348.2
4,674,194 A * 6/1987 Riley ..... 33/551
5,848,476 A * 12/1998 Grady ..... 33/1 Q
6,356,299 B1 3/2002 Trosino et al.
7,394,553 B2 * 7/2008 Carr et al. ..... 356/614

FOREIGN PATENT DOCUMENTS

JP 2000205806 A * 7/2000

OTHER PUBLICATIONS

"Central Pacific Railroad Photographic History Museum;" "Early Standard Gauge Track Spirit Level for Measuring Rail Superelevation on Curves;" May 20, 2009; pp. 1-3; http://cprr.org/Museum/Ephemera/track_level.html.
"Aldon Rail Safety p. 4;" May 20, 2009; pp. 1-10; http://www.westernsafety.com/aldon/aldonpage4.html.

* cited by examiner

*Primary Examiner* — Melissa Koval
*Assistant Examiner* — Temilade S Rhodes-Vivour
(74) *Attorney, Agent, or Firm* — McNees Wallace & Nurick LLC

(57) ABSTRACT

A tool and method for inspecting a track having a first rail and a second rail. The tool has a first mounting device which is attached to a first rail of the track. A cord attached to the mounting device is tensioned and positioning the cord in a proper position, allowing an inspector to measure a first distance between a defined point on the cord and the first rail or the second rail to determine if anomalies are present in the track.

19 Claims, 5 Drawing Sheets

STRINGLINE AND CROSS-LEVEL GAUGE

FIELD OF THE INVENTION

The present invention relates to the inspection of railroad tracks for anomalies, and more particularly, to a portable tool and method for inspecting railroad tracks.

BACKGROUND OF THE INVENTION

The Federal Railroad Administration (FRA) requires periodic inspection of railways to ensure safety of track structures. The inspection requirements of railways are set forth in 49 CFR Part 213. In addition to other types of required inspections, such as the biannual inspection of tracks with ultrasonic and magnetic testers for internal defects, visual inspections of the tracks are required.

49 CFR 213.233 (b) mandates that each inspection must be made on foot or by riding over the track in a vehicle at a speed that allows the person making the inspection to visually inspect the track structure for compliance. However, mechanical, electrical and other track inspection devices may be used to supplement visual inspection. If a vehicle is used for visual inspection, the speed of the vehicle may not be more than 5 miles per hour when passing over track crossings, highway crossings, or switches.

The frequency of such visual inspection varies with the class of the track. Each track is classified depending on, for instance, the type of use to which the track is subjected, e.g., freight, hazardous freight, passenger, etc.; the speed for which the track is rated; the number and weight of the cars typically travelling over the track; etc. The most rigorous inspection schedule is twice weekly with at least a one calendar day interval between inspections. 49 CFR 213.233 (c). Because a number of different rail usages trigger the most rigorous inspection schedule, most of the main line railroad in the United States is required to comply with twice weekly visual inspections.

The types of anomalies to be detected by visual inspection are set forth in Part 213 of 49 CFR and generally encompass anything that affects the structure of the track or the ability of trains to operate on the track. A competent inspector will note such things as loose spikes, defective ties, weeds or other growth near the tracks, brush or other growth blocking signals, blockage in a drainage ditch, catenary wires hanging too low, or a weakness in the ballast. Track inspectors sometimes find a crack in a rail, either by seeing the crack or, if the inspector is operating a vehicle, by hearing an unusual noise indicating a problem with the rail structure. Additionally, the inspector must take measurements regarding track alignment, surface profile, surface runoff, cross-level or super elevation to ensure the track is in compliance with the federally mandated Safety Standards.

Currently, visual inspection of track is accomplished by one of two methods. In the first method, an individual inspector walks a length of track, viewing the track for anomalies. Upon detecting an anomaly, the inspector takes measurements of the anomaly; notes the type of defect, measurements taken of the defect and approximate location of the anomaly; and either takes remedial action to correct the defect or orders an appropriate remedial action. Typically, a walking inspector covers 5 miles of track each day, at a rate of approximately 1.5 miles per hour. Because the FRA requires the track to be inspected twice per week, not on consecutive days, a standard inspection schedule for a walking inspector typically involves covering a five-mile segment of track on Monday, covering a second five-mile segment of track on Tuesday, repeating the first five-mile segment on Wednesday, repeating the second five-mile segment on Thursday, with Friday scheduled as a free day, enabling the inspector to inspect track that was missed during the week, for whatever reason, or to complete whatever paperwork is required.

In the second method, a vehicle is used to travel a length of track, with one or more inspectors viewing the track through a window. The vehicle is generally a truck adapted to ride on rails, more commonly called a high rail truck. Upon detection of an anomaly, the inspector may stop the vehicle to take measurement. As in the first method, the inspector takes the measurements; notes the type, measurements, and approximate location of the anomaly; and either takes remedial action or recommends an appropriate remedial action. Inspection by vehicle typically follows an inspection schedule similar to that of a walking inspector, covering one segment of track on Monday, a second segment on Tuesday, repeating the two segments on Wednesday and Thursday, respectively, with Friday as a scheduled free day.

Many visual inspections are performed using a high rail truck. However, in areas where there is a high traffic incidence, it is not feasible to tie up the track with a high rail truck during the day, and nighttime testing with the vehicle is difficult due to lighting constraints. Hence, walking inspection is required in such areas.

In all of these inspections, the inspectors must carry or use heavy, cumbersome tools to determine such things as track alignment, surface profiles, surface runoff, cross-level, super elevation, etc. The use of these cumbersome, multiple tools causes inspector inefficiencies. The weight of the tools makes it physically difficult for the inspector to carry the tools for long distances, particularly in harsh environments and over difficult terrain. In addition, due to the weight and size of these tools, three or more inspectors are required to properly manipulate the tools in order to perform the inspections.

Accordingly, it would be beneficial to provide portable, lightweight tools which could be easily manipulated by a single inspector. This would allow one inspector to inspect more track in a day than is currently inspected by multiple inspectors, thereby increasing the efficiency and decreasing the costs of such required inspections.

SUMMARY OF THE INVENTION

The invention is directed to a method for inspecting a track having a first rail and a second rail. The method includes the steps of: viewing the track to locate areas of concern in which an anomaly may be present and measuring the area of concern to determine if an anomaly is present and the size of the anomaly. The method of measuring includes the steps of: magnetically attaching a first mounting device to a first rail of the track; deploying a measuring line attached to the mounting device; positioning the measuring line in a proper position; and measuring a first distance between a defined point on the measuring line and the first rail or the second rail.

The method may also include the steps of: magnetically attaching the first mounting device to the gauge side of a head of the first rail of the track; positioning the measuring line in a horizontal position; measuring the first distance vertically from a middle of a top surface of a head of the first rail to the defined point on the measuring line; measuring a second distance from the first mounting device to the defined point on the measuring line; and calculating the rise of the track using the first distance and the second distance.

The method may also include the steps of: magnetically attaching the first mounting device to the gauge side of a head of the first rail of the track; positioning the measuring line in a horizontal position; magnetically attaching a second mounting device to the gauge side of the head of the first rail at a predetermined distance from the first mounting device; measuring the first distance from a midpoint of the measuring line to a point on the gauge side of the head of the first rail; and calculating the curvature of the track using the first distance and the predetermined distance.

The method may also include the steps of: magnetically attaching the first mounting device to the first rail of the track proximate to the area of concern and to a first side of the area of concern; magnetically attaching a second mounting device to the gauge side of the first rail of the track proximate the area of concern and to a second side of the area of concern which is opposite the first side; and measuring the first distance from the area of concern of the first rail to the defined point on the measuring line to determine if an anomaly is present and the severity of the anomaly.

The method may also include the steps of: attaching the first mounting device to a field side of a web of the first rail; tensioning the measuring line across a top surface of the head of the first rail toward the second rail; measuring the first distance vertically from a middle of a top surface of the head of the second rail to the measuring line; determining a second distance from the first rail to the second rail; and calculating the elevation of the second rail relative to the first rail using the first distance and the second distance.

The invention is also directed to a tool used for performing inspections on rails of track. The tool has a mounting assembly for engaging a first rail of the track and a measuring line. The mounting assembly has a base with a magnetic device which extends from a bottom surface of the base toward a top surface. The magnetic device is configured to magnetically engage the first rail of the track. A clip support member is provided on the mounting assembly and is spaced from the bottom surface. Upon the magnetic engagement of the magnetic device of the mounting assembly, the measuring line is extended to enable an inspector to determine if anomalies are present on the track.

The invention is directed to a method for inspecting a track having a first rail and a second rail. The method includes the steps of: viewing the track to locate areas of concern in which an anomaly may be present and measuring the area of concern to determine if the anomaly is present. The method of measuring includes the steps of: attaching a first mounting device to the first rail of the track; extending a measuring line attached to the mounting device; and measuring a first distance between a defined point on the measuring line and the first rail or the second rail.

The measuring line may be a beam of light which projects from the first mounting device or a cord which extends from the first mounting device. The method may also include the step of attaching a second mounting device to the first rail at a predetermined distance form the first mounting device.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
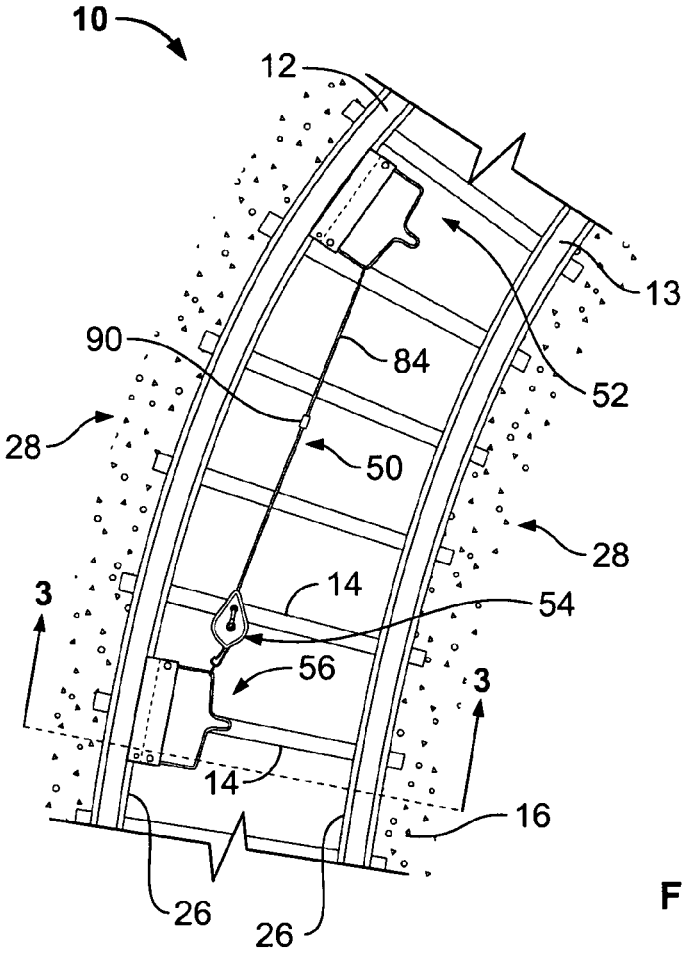
FIG. 1 is a top view of a curved track with a stringline tool according to the present invention extending along a curved portion of a rail of the track.
Figure 2:
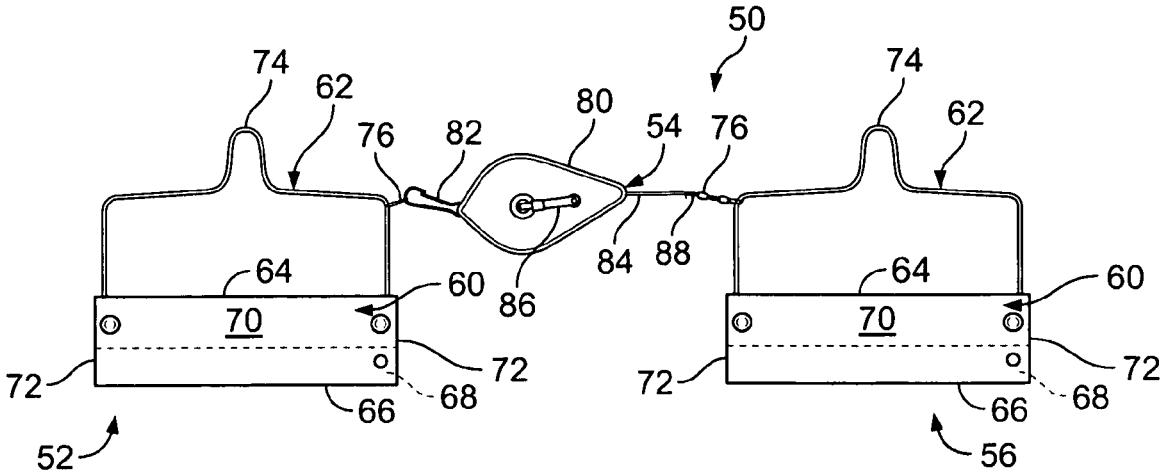
FIG. 2 is a perspective view of the stringline tool shown in FIG. 1, with a cord in a retracted position.
Figure 3:
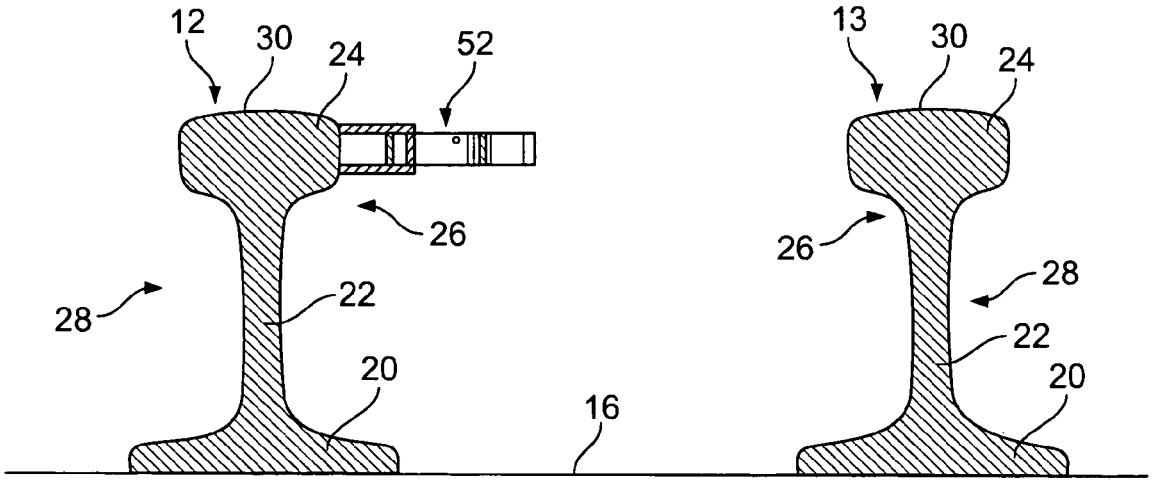
FIG. 3 is a cross-sectional view, taken along line 3-3 of FIG. 1, showing a magnetic device portion of the stringline tool in engagement with a head of the rail.

Referring to FIGS. 1-3, a stringline tool 50 is shown. The tool 50 is used for inspection of track 10. In particular, the tool 50 is used to measure various anomalies which are present in rails 12, 13 of the track 10, including, but not limited to, those related to track alignment, surface profiles, surface runoff, cross-level, super elevation.

Referring to FIGS. 1 and 3, the track 10 has two rails 12, 13 which are positioned on ties 14 laid on bed 16. Each rail 12, 13 has a base 20 which engages the ties 14, a web 22 which extends from the base 20, and a ball or head 24 which extends from the web 22 opposite the base 20. The head 24 has a top surface 30 which faces away from the bed 16. For ease of description, and using terms of art in the rail industry, the side of each rail which faces toward the opposing rail is referred to as the gauge side 26 and the side of each rail which faces away from the opposing rail is referred to as the field side 28. The gauge side and the field side of the head 24 are approximately ⅝ inches in height. The gauge side and the field side of the web 22 are generally greater than ⅝ inches in height.

Tool 50, as best shown in FIG. 2, has first mounting assembly 52, a stringline mechanism 54, and a second mounting assembly 56. As the first and second mounting assemblies 52, 56 are similar, the same reference numbers will be used for identical parts.

Each mounting assembly 52, 56 has a base 60 and handle 62. The base 60 has a top surface 64 and a bottom surface 66. A magnetic device 68 is positioned between sidewalls 70 and end walls 72 and extends from bottom surface 66. In the embodiment shown the magnetic device having a magnetic force of 95 lbs., but other size magnetic devices which produce sufficient magnetic fields may be used. The size of the magnetic device used will depend on the retention and release force desired. The dimensions of the base may vary, but the thickness of the magnetic device is approximately ½ inch. This is to ensure the measurement is taken at a point ⅝" down from the top of rail at the point where the wheel flange of the train touches the gauge side 26 of the rails 12, 13 of the track 10. It is at this point that the rail gauge matches the train gauge.

The handle 62 is attached to and extends from the end walls 72 of the base 60. In the embodiment shown, the handle 62 is riveted to the end walls 72, but any other known method of attaching the handle 62 to the end walls 72, e.g., screw, weld, nut and bolt, can be used. The handle can also be attached to the sidewalls 70 or any other portion of the base 60. In the embodiment shown, the handle 62 has a generally C-shaped configuration with a mounting section 74 positioned proximate the center thereof. The mounting section 74 is used to attach the mounting assembly 52, 56 to a tool belt (not shown) or the like. The function of the handle 62 is to allow the inspector to easily grasp the mounting assembly 52, 56, thereby allowing the inspector to easily position the mounting assembly 52, 56 on the rail 12, 13 and to remove the mounting assembly 52, 56 therefrom. Therefore, the particular configuration of the handle 62 can vary without departing from the invention.

A clip support member 76 extends from the handle 62. The clip support member 76 is spaced consistently from the bottom surface 66 of the base 60. In the embodiment shown, the clip support member 76 is spaced 2 inches from the bottom surface 66, but other spacing can be used, so long as the spacing is consistent for first mounting assembly 52 and second mounting assembly 56.

The stringline mechanism 54 has take-up reel 80 with a clip 82 extending from one side thereof and an extendable cord 84 extending from the other side. A rotatable handle 86 is provided to allow the inspector to retract the cord 84 as required. The cord 84 has a clip 88 attached to the free end of the cord which extends from the take-up reel 80. The take-up reel is a commercially available product and is sold as a plum bob. The take-up reel 80 is made from a material which is not attracted to a magnetic device, such as aluminum. As take-up reels 80 are known in the art, a detailed description of its operation will not be provided. The clip 82 engages the clip support member 76 of the first mounting assembly 52, and the clip 88 engages the clip support member 76 of the second mounting assembly 56. This allows the mounting assemblies 52, 56 to be moved away from each other by the length of the take-up reel 80 and the length of the cord 84. Although the overall extended length of the stringline mechanism can vary, the stringline mechanism generally has an extended length of 62 feet, 31 feet or 20 feet. The variation in the length becomes more relevant when measuring the curvature of track 10, as will be more fully described below. A midpoint 90 of the cord 84 is marked, regardless of the length of the cord 84. Although stringline mechanism 54 is shown and described herein, other types of mechanisms or measuring lines can be used, e.g. a simple cord or string with no take-up reel. In addition, the stringline mechanism and cord could be replaced by a measuring line which is a beam of light transmitted from either of the mounting assemblies 52, 56. If a beam of light is transmitted, one mounting assembly may be sufficient, thereby eliminating the need for the second mounting assembly. The beam of light, the cord, or any other device used are generically referred to as a measuring line.

A measuring device is provided to facilitate the inspection process. The measuring device may be a measuring tape, ruler or any device that allows the operator to determine distance from the cord to the rail.

As shown in FIGS. 6 through 10, the tool 50 may have a level 94 attached to the cord 84. The level 94 may be attached by end caps 96 which have longitudinally extending slots 98 into which the cord 84 may be inserted and maintained. However, other ways of attaching the level to the cord, e.g., clips, Velcro, can be used without departing from the invention.

The tool 50 is designed to be lightweight and easy to carry. Whether the inspector is conducting a walking inspection or an inspection using a high rail truck, the use of this lightweight tool allows the inspector to more easily manipulate the tool and, consequently, allows the inspection to proceed more quickly. In addition, the use of the tool 50 allows one inspector to conduct inspections. Previously, the tools used by inspectors were heavy and cumbersome, requiring that more than one inspector be present to deploy the tools and take measurements. The costly use of multiple inspectors is not needed with the use of the tool 50 described and claimed herein.

The tool 50 allows the inspector to make measurements while performing his/her routine inspections. These measurements allow the inspector to check for anomalies related to track alignment, surface profile, surface runoff, cross-level and super elevation.

With respect to track alignment, the inspector can measure track alignment for both curved and straight track. To check for misalignment of a curved section of track, the inspector visually inspects the track as he walks. When the inspector views a section of track which he/she does not believe is properly aligned, the inspector takes measurements to determine if an anomaly is present. Referring to FIG. 1, to do this, the inspector mounts or attaches the first mounting assembly 52 to the gauge side 26 of the head 24 of the first rail 12. The first mounting assembly 52 is mounted by the cooperation of the magnetic device 68 to the head of the first rail 12. As previously described, the magnetic device is ½ inches thick, which allows the first mounting assembly 52 to be fully and properly mounted on the gauge side 26 of the head 24 at a location which is ⅝ inches down from the top of the rail. The inspector then extends the cord 84 to its full length. The second mounting assembly 56 is then mounted to the gauge side 26 of the head 24 of the first rail 12. The second mounting assembly 56 is mounted by the cooperation of the magnetic device 68 to the head of the first rail 12. The second mounting assembly 56 is mounted so that the cord 84 is maintained in a taut or stretched position. With the tool 50 properly positioned, the inspector uses the measuring device to measure the distance between the midpoint 90 of the cord 84 and the gauge side 26 of the head 24 of the first rail 12. The measurement obtained must be modified by subtracting 2 inches therefrom, as the cord 84 is two inches removed from the gauge side 26 of the head 24 of the first rail 12 at the mounting assemblies 52, 56. Using the modified measurement and the length of the cord, the inspector can calculate the curvature of the track to determine if it is within the defined standards. The variation of the curvature of the track allowed depends on the class of service which travels the tracks and the maximum speed in the area. In slower speed areas, the track may turn more quickly. In such areas, a 62 foot cord may not be used, as the length of the curve is too short, and meaningful measurements could not be taken. In such instances, the 31 foot or 20 foot cords would be used. If a 62 foot cord is used, the number of inches that the cord extends away from the rail minus the two inch offset is equal to the degree of curvature. As an example, if the cord is 8 inches from the rail at the midpoint 90, the degree of curvature of the rail is 6 degrees (8 minus 2). If a 31 foot cord is used the degree of curvature is equal to (the number of inches that the cord extends away from the rail minus the two inch offset) divided by 4. If a 20 foot cord is used the degree of curvature is equal to (the number of inches that the cord extends away from the rail minus the two inch offset) divided by 10. While the drawings show the first rail 12 as the left rail, the first rail 12 may also be the right rail.

Figure 4:
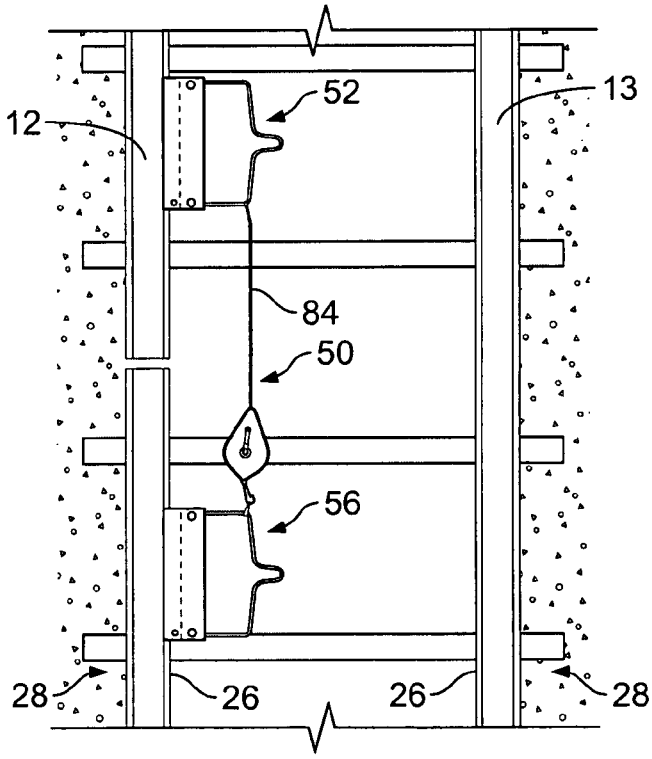
FIG. 4 is a top view of a straight track with a first anomaly, with the stringline tool of FIG. 2 extending along a first portion of the rail of the track.

Referring to FIG. 4, to check for misalignment of a straight section of track, the inspector visually inspects the track as he walks. When the inspector views a section of track which he/she believes is not properly aligned, the inspector takes measurements to determine if an anomaly is present. To do this, the inspector mounts or attaches the first mounting assembly 52 to the gauge side 26 of the head 24 of the first rail 12 on one side of the anomaly. The first mounting assembly 52 is mounted by the cooperation of the magnetic device 68 to the head of the first rail 12. As previously described, the magnetic device is ½ inches thick, which allows the first mounting assembly 52 to be fully and properly mounted on the gauge side 26 of the head 24 at a location ⅝ of an inch from the top of the rail. The inspector then extends the cord 84 across the area in which the anomaly is present. The second mounting assembly 56 is then mounted to the gauge side 26 of the head 24 of the first rail 12. The second mounting assembly 56 is mounted by the cooperation of the magnetic device 68 to the head of the first rail 12. The second mounting assembly 56 is mounted so that the cord 84 is maintained in a taut or stretched position. With the tool 50 properly positioned, the inspector uses the measuring device to measure the distance between the cord 84 and the gauge side 26 of the head 24 of the first rail 12 where the anomaly is present. The measurement obtained must be modified by subtracting 2 inches therefrom, as the cord 84 is two inches removed from the gauge side 26 of the head 24 of the first rail 12 at the mounting assembly 52. Using the modified measurement, the inspector can calculate the severity of the anomaly and determine if it is within the defined standards. While the drawings show the first rail 12 as the left rail, the first rail 12 may also be the right rail.

Figure 5:
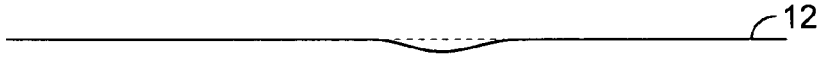
FIG. 5 is a side view of a straight track with a second anomaly, with the cord extending along a second portion of the rail of the track.
Figure 6:
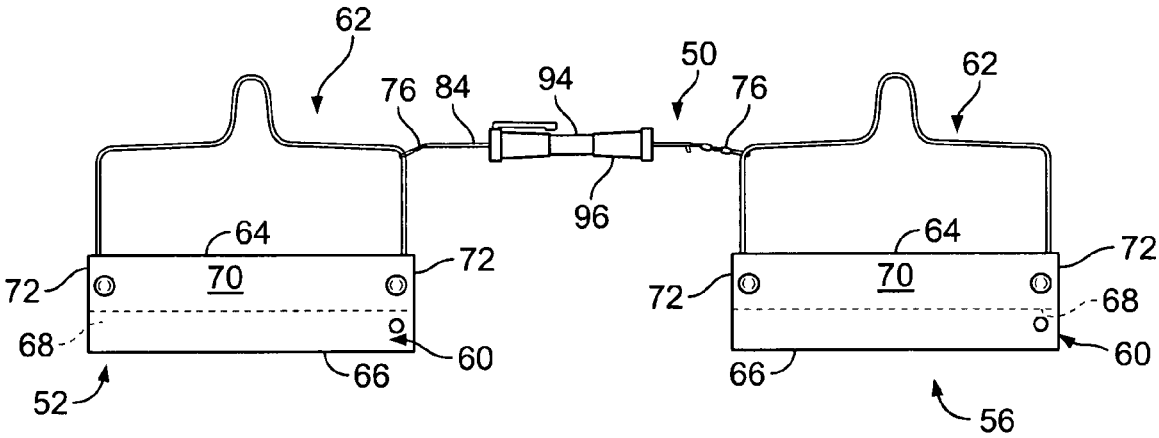
FIG. 6 is a perspective view of a stringline tool similar to that shown in FIG. 1, with the cord in a partially retracted position and a level attached to the cord.

Referring to FIG. 5, with respect to surface profile or a depression or bump in either rail 12, 13, the inspector visually inspects the track as he walks. When the inspector views a section of track which he/she believes has an improper depression or bump in the rail, the inspector takes measurements to determine the severity of the anomaly. If the anomaly occurs in the first rail 12, the inspector mounts or attaches the first mounting assembly 52 to the top center of the head 24 of the first rail 12 on one side of the anomaly. The first mounting assembly 52 is mounted by the cooperation of the magnetic device 68 to the head of the first rail 12. As previously described, the magnetic device is ½ inches thick, which allows the first mounting assembly 52 to be fully and properly mounted on the top center of the rail which is 2-3.5 inches wide. The inspector then extends the cord 84 across the area in which the anomaly is present. The second mounting assembly 56 is then mounted to the top center of the head 24 of the first rail 12. The second mounting assembly 56 is mounted by the cooperation of the magnetic device 68 to the head of the first rail 12. The second mounting assembly 56 is mounted so that the cord 84 is maintained in a taut or stretched position. With the tool 50 properly positioned, the inspector uses the measuring device to vertically measure the distance between the cord 84 and the top of the head 24 of the first rail 12 where the anomaly is present. Using the modified measurement, the inspector can calculate the severity of the anomaly and determine if it is within the defined standards. While the drawings show the first rail 12 as the left rail, the first rail 12 may also be the right rail.

Figure 7:
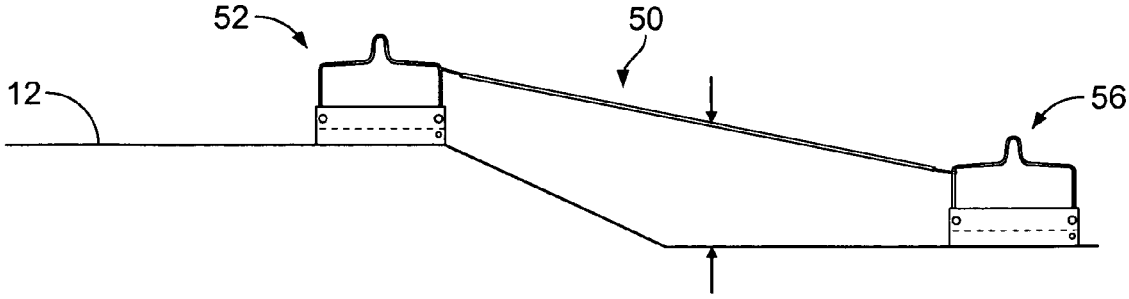
FIG. 7 is a side view of a straight track with a third anomaly, with a magnetic device portion of the stringline tool of FIG. 6 attached to the head of the rail of the track at one end and the cord extending in a horizontal plane therefrom.

Referring to FIG. 7, with respect to surface runoff, the inspector visually inspects the track as he walks. When the inspector views a section of track which he/she believes has an improper inclination over a certain length, the inspector takes measurements to determine if an anomaly is present. To do this, the inspector mounts or attaches the first mounting assembly 52 to the top center of the head 24 of the first rail 12 on one side of the anomaly. The first mounting assembly 52 is mounted by the cooperation of the magnetic device 68 to the head of the first rail 12 proximate the start of the inclined area. As previously described, the magnetic device is ½ inches thick, which allows the first mounting assembly 52 to be fully and properly mounted on the top center of the head 24 which is 2-3.5 inches wide. The inspector then extends the 62 foot cord 84 across the area in which the anomaly is present and attaches the second mounting device to the top center of the same rail as the first mounting device. The inspector uses the measuring device to vertically measure the distance between the cord 54 and the middle of a top surface 30 of the first rail 12 at a point 31 feet from the first mounting device. The inspector can calculate the severity of the inclination and determine if it is within the defined standards. While the drawings show the first rail 12 as the left rail, the first rail 12 may also be the right rail.

Figure 8:
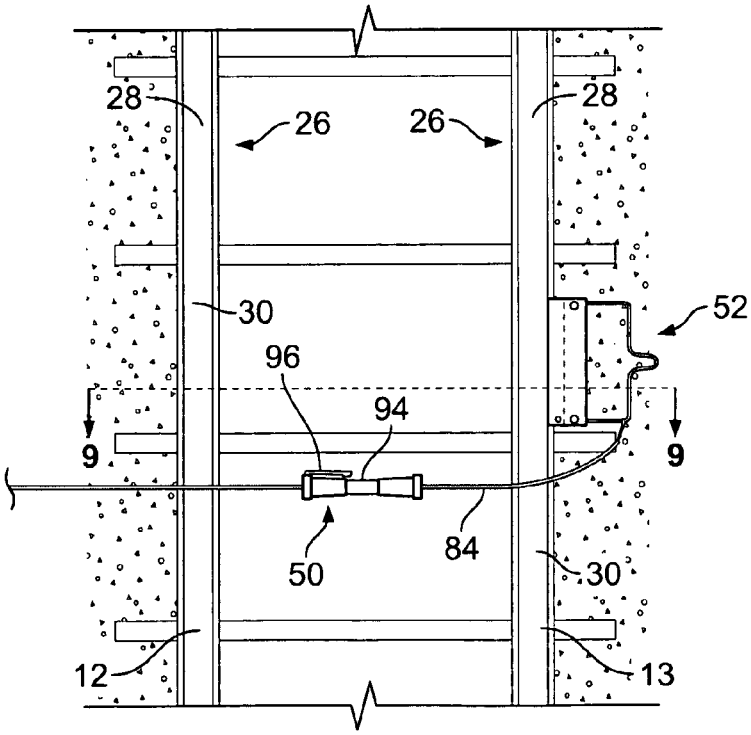
FIG. 8 is a top view of a straight track with the magnetic device portion of the stringline tool of FIG. 6 attached to the web of the rail of the track at one end and the cord extending across the rail in a horizontal plane therefrom.
Figure 9:
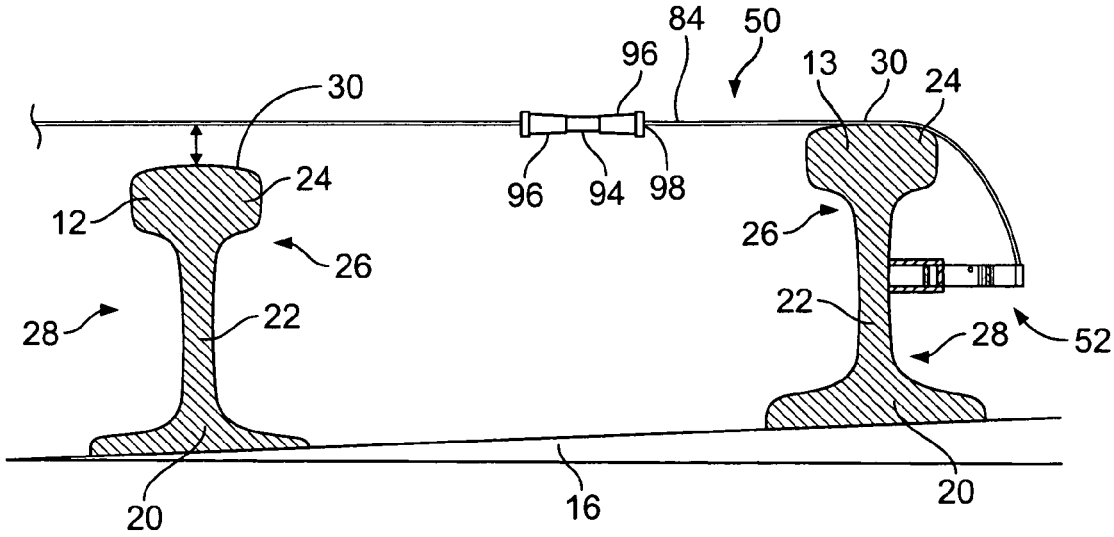
FIG. 9 is a cross-sectional view, taken along line 9-9 of FIG. 8.

Referring to FIGS. 8 and 9, with respect to cross-level, the inspector visually inspects the track as he walks. When the inspector views a section of track in which he/she believes that the rails 12, 13 are not properly leveled with respect to each other, i.e., one rail is lower than the other, the inspector takes measurements to determine if an anomaly is present. To do this, the inspector mounts or attaches the first mounting assembly 52 to the field side 28 of the web 22 of the second rail 13 on one side of the anomaly. The first mounting assembly 52 is mounted by the cooperation of the magnetic device 68 to the web 22 of the second rail 13. The inspector then extends the cord 84 across the top surface 30 of the second rail 13 toward the first rail 12 and places the level 94 on the cord 84. The inspector uses the level 94 to position the cord in a horizontal position. The inspector uses the measuring device to vertically measure a first distance between the cord 84 and the middle of a top surface 30 of the first rail 12. The inspector also determines a second distance or spacing between the rails by using the standard spacing between the rails 12, 13 or by using the measuring device to measure a second distance between the mounting assembly and the point on the cord 84 where the first distance was measured. Using the first distance and the second distance, the inspector can calculate the amount of difference in the cross-level of the rails and determine if it is within the defined standards. While the drawings show the first rail 12 as the left rail, the first rail 12 may also be the right rail.

Figure 10:
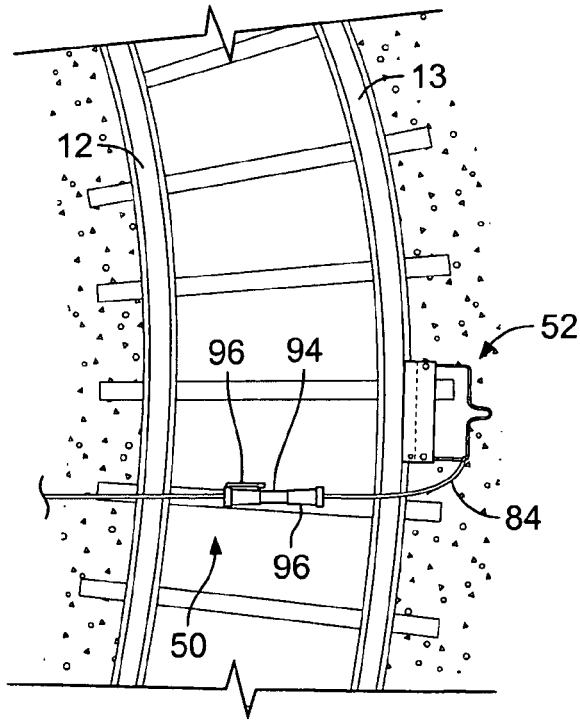
FIG. 10 is a top view of a curved track with the magnetic device portion of the stringline tool of FIG. 6 attached to the web of the rail of the track at one end and the cord extending across the rail in a horizontal plane therefrom.

Referring to FIG. 10, with respect to super elevation, the inspector visually inspects the track as he walks. When the inspector views a section of track in which he/she believes that the rails 12, 13 are not banked properly in a curve, the inspector takes measurements to determine if an anomaly is present. To do this, the inspector mounts or attaches the first mounting assembly 52 to the field side 28 of the web 22 of the second rail 13 on one side of the anomaly. The first mounting assembly 52 is mounted by the cooperation of the magnetic device 68 to the web 22 of the second rail 13. The inspector than extends the cord 84 across the top surface 30 of the second rail 13 toward the first rail 12 and places the level 94 on the cord 84. The inspector uses the level 94 to position the cord in a horizontal position. The inspector uses the measuring device to vertically measure a first distance between the cord 84 and the middle of a top surface 30 of the first rail 12. The inspector also determines a second distance or spacing between the rails by using the standard spacing between the rails 12, 13 or by using the measuring device to measure a second distance between the end of the mounting assembly and the point on the cord 84 where the first distance was measured. Using the first distance and the second distance, the inspector can calculate the degree of super elevation of the track and determine if it is within the defined standards. While the drawings show the first rail 12 as the left rail, the first rail 12 may also be the right rail.

As is evident from the above description, the tool 50 can be used to perform various measurements. This enhances the productivity of the inspector, as the inspector can use one tool for all measurements. In addition, as only one tool must be carried by the inspector, the inspector is not weighted down by numerous, heavy tools, thereby allowing the inspector to inspect more track in a given time.

The tool 50 is also durable. Unlike prior art measuring devices, the tool 50 is attached to the side of the rails 12, 13 by magnetic device. In corridors in which train traffic is extremely heavy, inspectors must quickly inspect the track during the intervals between trains. Because of this timing constraint, it is sometimes difficult to remove all tools from the track before the next train arrives. With prior tools, if a train ran over the tool, the weight of the train would destroy the tool. However, with the tool 50, the wheels of the train will contact the tool 50 and merely push the tool 50 toward the bed 16. As the tool 50 is mounted on the side (either gauge or field) of the rails 12, 13, and as the mounting assemblies 52, 56 are maintained in position by the magnetic device force, the weight of the train causes the mounting assemblies to be slid toward the bed 16. Consequently, the tool 50 is not damaged and can be recovered after the train has passed.

The ability to quickly mount and dismount the mounting assemblies 52, 56 is also beneficial. In corridors where train traffic is extremely heavy, the ability of the inspector to quickly position the tool 50, take measurements, and quickly disconnect the tool 50 is beneficial. Therefore, the use of magnetic devices 68 or other quick-release clip support members facilitates the speed of the inspections and enhances safety, since the inspectors can quickly stop the inspection as a train approaches.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for inspecting a track during intervals between trains, the track having a first rail and a second rail, the method comprising the steps of:

viewing the track to locate areas of concern in which an anomaly may be present;

measuring the area of concern to determine if the anomaly is present, comprising the steps of:

magnetically attaching a first mounting device to a gauge side or a field side of a first rail of the track;

deploying a measuring line attached to the mounting device an appropriate distance to measure the anomaly;

defining a defined point on the measuring line;

measuring a first distance between the defined point on the measuring line and the first rail or the second rail;

whereby the first mounting device is magnetically attached to the gauge side or the field side of the first rail of the track to permit the first mounting device to be slid toward a bed of the track when engaged by wheels of a respective train as the train passes over the first mounting device which allows for the method to be used in corridors where train traffic is heavy.

2. The method of claim 1, further comprising the step of:

magnetically attaching the first mounting device to the gauge side of a head of the first rail of the track at a location approximately ⅝ inches down from a top of the first rail.

3. The method of claim 2, further comprising the steps of:

positioning the measuring line in a horizontal position on a top surface of the first rail;

measuring the first distance vertically from a middle of a top surface of a head of the first rail to the defined point on the measuring line;

measuring a second distance from a base of the first mounting device to the defined point on the measuring line;

calculating the rise of the track using the first distance and the second distance.

4. The method of claim 2, further comprising the step of:

magnetically attaching a second mounting device to the gauge side of the head of the first rail at a predetermined distance from the first mounting device.

5. The method of claim 4, further comprising the steps of:

tensioning the measuring line;

measuring the first distance from a midpoint of the measuring line to a point on the gauge side of the head of the first rail;

calculating the curvature of the track using the first distance and the predetermined distance.

6. The method of claim 1, wherein measuring the area of concern to determine if the anomaly is present further comprising the steps of:

magnetically attaching the first mounting device to the first rail of the track at an appropriate distance to the area of concern and to a first side of the area of concern;

magnetically attaching a second mounting device to the first rail of the track proximate the area of concern and to a second side of the area of concern which is opposite the first side; and measuring the first distance from the area of concern of the first rail to the defined point on the measuring line to determine if an anomaly is present and the severity of the anomaly.

7. The method of claim 1, further comprising the step of:

tensioning the measuring line across a top surface of a head of the first rail toward the second rail.

8. The method of claim 7, further comprising the steps of:

extending the measuring line across the top surface of the first rail and perpendicular to the first rail until it is over a top surface of a head of the second rail, measuring the first distance vertically from a middle of the top surface of the head of the second rail to the measuring line while the measuring line is maintained in a horizontal plane using a level;

calculating the elevation of the second rail relative to the first rail.

9. A tool used for performing inspections on rails of track, the tool comprising;

a mounting assembly for engaging a first rail of the track, the mounting assembly comprising;

a base having a magnetic device which extends from a bottom surface of the base toward a top surface, the magnetic device configured to magnetically engage the first rail of the track, a clip support member spaced from the bottom surface;

a measuring line having a clip engaging the clip support member;

whereby upon the magnetic engagement of the magnetic device of the mounting assembly to the first rail, the measuring line is extended to enable an inspector to determine if anomalies are present on the track.

10. The tool as recited in claim 9 wherein the tool has a second mounting assembly for engaging a respective rail of the track, the mounting assembly comprising;

a second base having a second magnetic device which extends from a second bottom surface of the second base toward a second top surface, the second magnetic device configured to magnetically engage the respective rail of the track, and a second clip support member spaced from the second bottom surface of the second base.

11. The tool as recited in claim 10 wherein each of the mounting assemblies have a handle attached to the respective base.

12. The tool as recited in claim 9 wherein the measuring line is a retractable cord extending from a take-up reel provided with a rotatable handle, the handle allowing the inspector to retract the cord as required, the take-up reel having a take-up reel clip engaging a respective clip support member of either the mounting assemblies.

13. The tool as recited in claim 9 wherein the measuring line has a midpoint which is identified and marked to assist the inspector in determining if anomalies are present on the track.

14. The tool as recited in claim 9 wherein a level being attached to the cord to assist the inspector in determining if anomalies are present on the track.

15. The tool as recited in claim 14 wherein the level having end caps with slots into which the cord is removably attached.

16. A method for inspecting a track during intervals between trains, the track having a first rail and a second rail, the method comprising the steps of:

viewing the track to locate areas of concern in which an anomaly may be present;

measuring the area of concern to determine if the anomaly is present, comprising the steps of:

attaching a first mounting device to a gauge side or field side of the first rail of the track;

extending a measuring line attached to the mounting device an appropriate distance to measure the anomaly;

defining a defined point on the measuring line;

measuring a first distance between the defined point on the measuring line and the first rail or the second rail;

whereby the first and the second mounting devices are attached to the gauge side or the field side of the first rail of the track to permit either the first mounting device or the second mounting device to be slid toward a bed of the track when the respective first mounting device or second mounting device is engaged by wheels of a respective train as the train passes over the first mounting device or the second mounting device which allows for the method to be used in corridors where train traffic is heavy.

17. The method of claim 16, wherein the measuring line is a beam of light which projects from the first mounting device.

18. The method of claim 16, wherein the measuring line is a cord which extends from the first mounting device.

19. The method of claim 18, further comprising the step of:

attaching a second mounting device to the first rail at a predetermined distance from the first mounting device.

* * * * *